US008125412B2

(12) United States Patent
Huh et al.

(10) Patent No.: US 8,125,412 B2
(45) Date of Patent: Feb. 28, 2012

(54) PLASMA DISPLAY APPARATUS AND METHOD OF DRIVING THE SAME

(75) Inventors: Yonghyun Huh, Gumi (KR); Mukhee Kim, Gumi (KR); Yunkwon Jung, Gumi (KR); Hyunjae Lim, Gumi (KR)

(73) Assignee: LG Electronics Inc., Seoul (KR)

( * ) Notice: Subject to any disclaimer, the term of this patent is extended or adjusted under 35 U.S.C. 154(b) by 1134 days.

(21) Appl. No.: 11/943,004

(22) Filed: Nov. 20, 2007

(65) Prior Publication Data

US 2008/0122742 A1 May 29, 2008

(30) Foreign Application Priority Data

Nov. 29, 2006 (KR) ..... 10-2006-0119396

(51) Int. Cl.
*G09G 3/20* (2006.01)
*G09G 3/28* (2006.01)

(52) U.S. Cl. ..... 345/60; 345/55

(58) Field of Classification Search ..... 345/60, 345/55

See application file for complete search history.

(56) References Cited

U.S. PATENT DOCUMENTS

| | | | | |
|---|---|---|---|---|
| 6,906,690 | B2 * | 6/2005 | Lim | 345/60 |
| 7,561,120 | B2 * | 7/2009 | Lee et al. | 345/60 |
| 7,705,804 | B2 * | 4/2010 | Kim | 345/60 |
| 7,907,103 | B2 * | 3/2011 | Jung et al. | 345/63 |
| 7,911,413 | B2 * | 3/2011 | Choi | 345/60 |
| 2005/0134532 | A1 * | 6/2005 | Choi et al. | 345/60 |
| 2006/0050019 | A1 * | 3/2006 | Kim | 345/60 |
| 2009/0015520 | A1 | 1/2009 | Akamatsu et al. | 345/67 |

FOREIGN PATENT DOCUMENTS

| | | | |
|---|---|---|---|
| CN | 1619622 | A | 5/2005 |
| EP | 1 533 781 | A2 | 5/2005 |
| EP | 1 744 296 | A2 | 1/2007 |
| EP | 1 862 998 | A2 | 12/2007 |
| JP | 2001-356733 | | 12/2001 |
| JP | 2005-165289 | | 6/2005 |
| KR | 10-2004-0024361 | A | 3/2004 |
| KR | 10-2004-0072366 | A | 8/2004 |
| KR | 10-2005-0044949 | A | 5/2005 |
| KR | 10-0566819 | B1 | 3/2006 |
| WO | WO 2006/112233 | A1 | 10/2006 |

OTHER PUBLICATIONS

Chinese Office Action dated Dec. 4, 2009.
PCT Search Report dated Feb. 18, 2008.
Korean Decision to Grant a Patent dated Aug. 20, 2007.
European Search Report dated Oct. 16, 2009.

* cited by examiner

*Primary Examiner* — Amare Mengistu
*Assistant Examiner* — Aaron M Guertin
(74) *Attorney, Agent, or Firm* — KED & Asssociates LLP

(57) ABSTRACT

A plasma display apparatus and a method of driving the same are disclosed. The plasma display apparatus includes a plasma display panel comprising a first electrode and a second electrode, and a driver. The driver supplies a ramp-up signal in which a voltage gradually rises to the first electrode in a setup period of a reset period, supplies a ramp-down signal in which a voltage gradually falls to the first electrode in a set down period after the setup period, and supplies at least one reset stabilization signal to the first electrode in a period before the ramp-down signal is supplied after the ramp-up signal is supplied.

18 Claims, 13 Drawing Sheets

(a)

(b)

PLASMA DISPLAY APPARATUS AND METHOD OF DRIVING THE SAME

This application claims the benefit of Korean Patent Application No. 10-2006-0119396 filed on Nov. 29, 2006 which is hereby incorporated by reference.

BACKGROUND OF THE DISCLOSURE

1. Field of the Disclosure

This document relates to a plasma display apparatus and a method of driving the same.

2. Description of the Related Art

A plasma display apparatus includes a plasma display panel and a driver for driving the plasma display panel.

The plasma display panel has the structure in which barrier ribs formed between a front panel and a rear panel forms unit discharge cell or a plurality of discharge cells. Each discharge cell is filled with an inert gas containing a main discharge gas such as neon (Ne), helium (He) or a mixture of Ne and He, and a small amount of xenon (Xe). The plurality of discharge cells form one pixel. For example, a red (R) discharge cell, a green (G) discharge cell, and a blue (B) discharge cell form one pixel. When the plasma display panel is discharged by applying a high frequency voltage to the discharge cell, the inert gas generates vacuum ultraviolet rays, which thereby cause phosphors formed between the barrier ribs to emit light, thus displaying an image. Since the plasma display apparatus can be manufactured to be thin and light, it has attracted attention as a next generation display device.

SUMMARY OF THE DISCLOSURE

In one aspect, a plasma display apparatus comprising: a plasma display panel comprising a first electrode and a second electrode; and a driver that supplies a ramp-up signal in which a voltage gradually rises to the first electrode in a setup period of a reset period, supplies a ramp-down signal in which a voltage gradually falls to the first electrode in a set down period following the setup period, and supplies at least one reset stabilization signal to the first electrode in a period before the ramp-down signal is supplied after the ramp-up signal is supplied.

In another aspect, a method of driving a plasma display apparatus comprising a first electrode and a second electrode, comprising: supplying a ramp-up signal in which a voltage gradually rises to the first electrode in a setup period of a reset period, and supplying a ramp-down signal in which a voltage gradually falls to the first electrode in a set down period after the setup period, and supplying at least one reset stabilization signal to the first electrode in a period before the ramp-down signal is supplied after the ramp-up signal is supplied.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
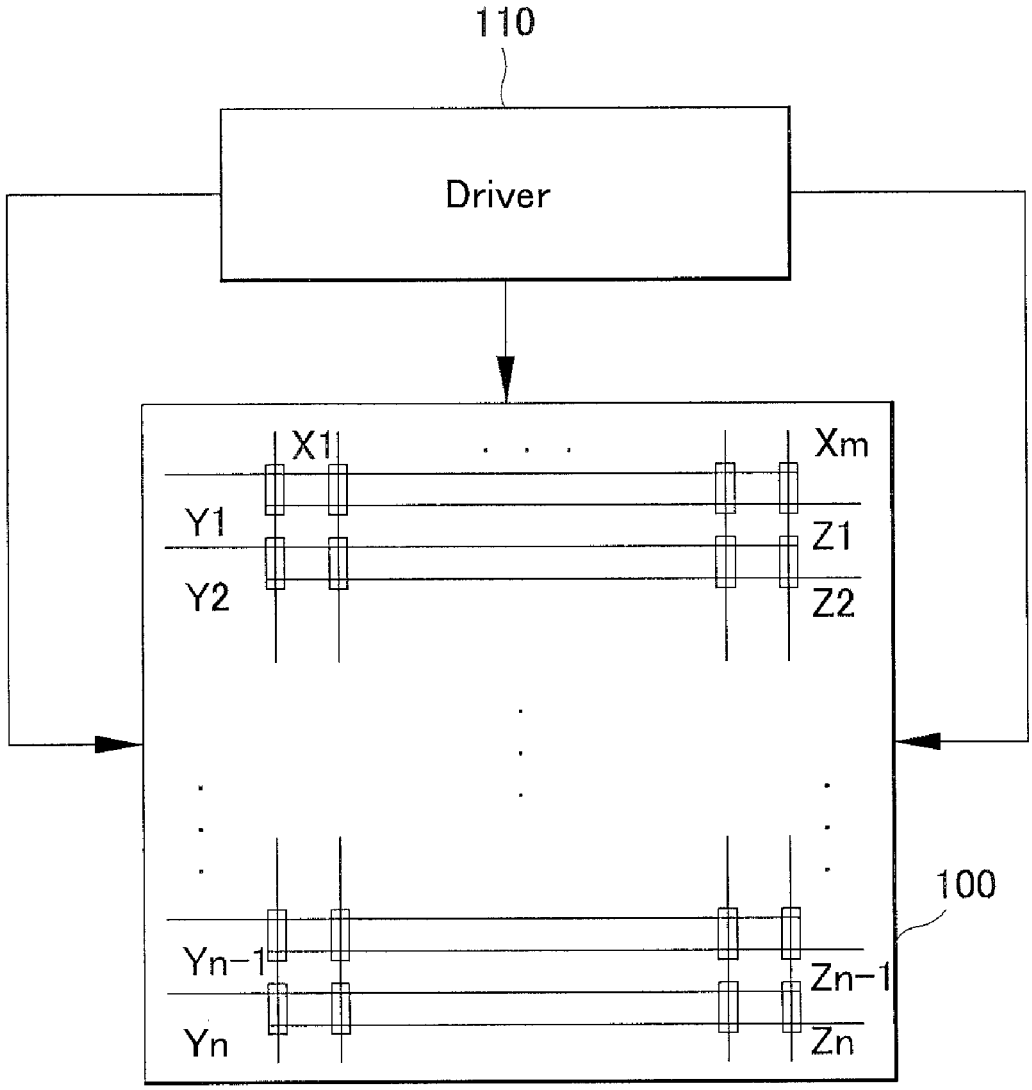
FIG. 1 is a diagram illustrating a configuration of a plasma display apparatus in an implementation.

FIG. 1 is a diagram illustrating a configuration of a plasma display apparatus in an implementation.

Referring to FIG. 1, the plasma display apparatus comprises a plasma display panel 100 and a driver 110.

The plasma display panel 100 comprises first electrodes (Y1 to Yn) and second electrodes (Z1 to Zn) in parallel to each other and further comprises third electrodes (X1 to Xm) intersecting the first electrodes and the second electrodes.

The driver 110 supplies a ramp-up signal in which a voltage gradually rises to the first electrode of the plasma display panel 100 in a setup period of a reset period for initialization, supplies a ramp-down signal in which a voltage gradually falls to the first electrode in a set down period after the setup period, supplies at least one reset stabilization signal to the first electrode in a period before a ramp-down signal is supplied after a ramp-up signal is supplied, and supplies at least one sustain rising signal to the second electrode.

FIG. 1 shows only a case where the driver 110 is formed in one board, however the driver 110 may be formed in a plurality of boards according to an electrode formed in the plasma display panel 100.

For example, the driver 110 may be divided into a first driver (not shown) for driving the first electrode of the plasma display panel 100, a second driver for driving the second electrode, and a third driver (not shown) for driving the third electrode.

Figure 2:
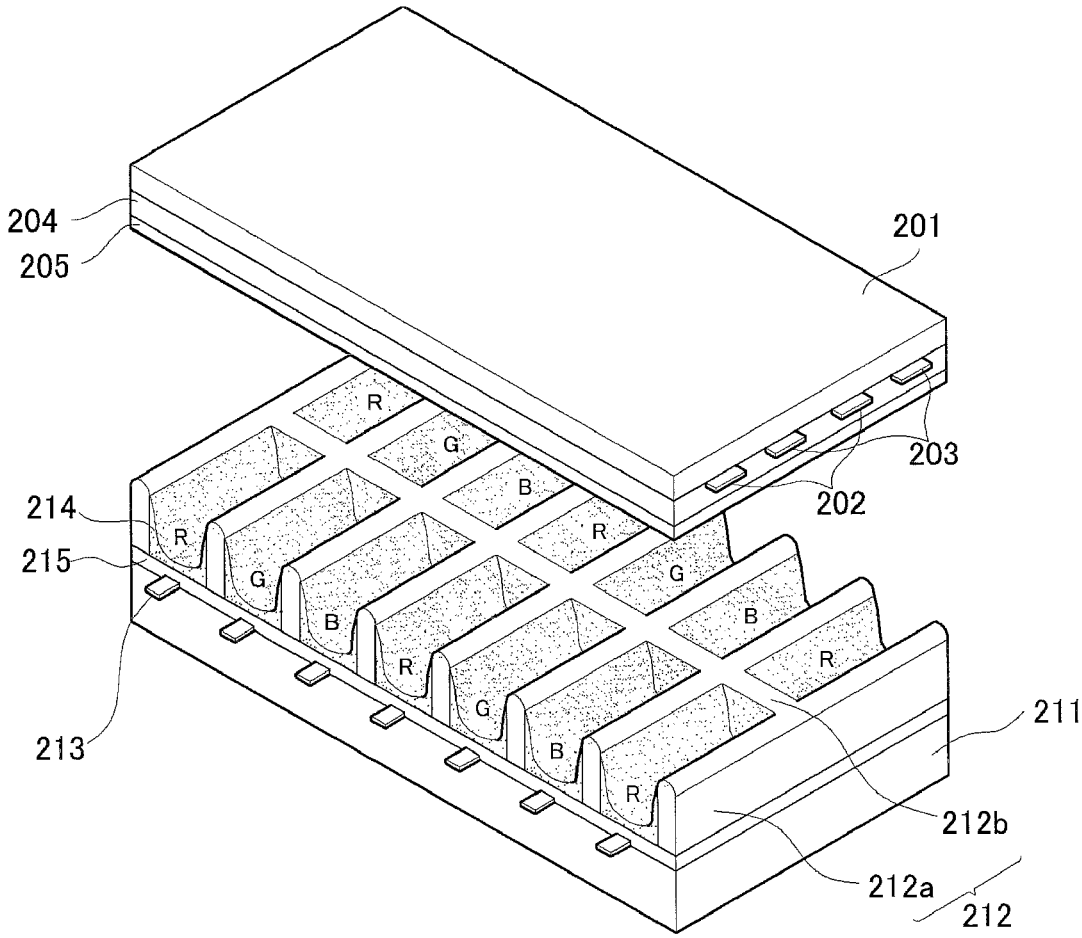
FIG. 2 is a perspective view illustrating a structure of a plasma display panel that can be comprised in a plasma display apparatus in an implementation.

FIG. 2 is a perspective view illustrating a structure of a plasma display panel that can be comprised in a plasma display apparatus in an implementation.

Referring to FIG. 2, the plasma display panel that can be comprised in the plasma display apparatus in an implementation is formed by coupling a front substrate 201 in which first electrodes 202 (Y) and second electrodes 203 (Z) in parallel to each other are formed and a rear substrate 211 in which third electrodes 213 (X) intersecting the first electrodes 202 and the second electrodes 203 are formed.

A dielectric layer, for example an upper dielectric layer 204 for covering the first electrodes 202 and the second electrodes 203 is formed in the front substrate 201 in which the first electrodes 202 and the second electrodes 203 are formed.

The upper dielectric layer 204 limits a discharge current of the first electrodes 202 and the second electrodes 203 and insulates the first electrodes 202 and the second electrodes 203 from each other.

A protection layer 205 for facilitating a discharge condition is formed in the front substrate 201 in which the upper dielectric layer 204 is formed. The protection layer 205 is made of magnesium oxide (MgO). The protective layer 205 is formed, for example, with a method of depositing magnesium oxide (MgO) on the upper dielectric layer 204.

An electrode, for example the third electrode 213 is formed on the rear substrate 211, and a dielectric layer, for example, a lower dielectric layer 215 for covering the third electrode 213 is formed on the rear substrate 211 in which the third electrode 213 is formed.

The lower dielectric layer 215 insulates the third electrode 213.

A barrier rib 212 of a stripe type, a well type, a delta type, a hive type, etc. for partitioning a discharge space, i.e. a discharge cell is formed in an upper part of the lower dielectric layer 215. Accordingly, a red color R discharge cell, a green color G discharge cell, and a blue color B discharge cell are formed between the front substrate 201 and the rear substrate 211.

Further, in addition to the red color R discharge cell, the green color G discharge cell, and the blue color B discharge cell, a white color W discharge cell or a yellow color Y discharge cell may be further formed.

Widths of the red color R discharge cell, the green color G discharge cell, and the blue color B discharge cell in the plasma display panel that can be applied to the plasma display apparatus in the implementation may be substantially equal, however a width of at least one of the red color R discharge cell, the green color G discharge cell, and the blue color B discharge cell may be different from that of other discharge cells.

For example, a width of the red color R discharge cell may be smallest, and widths of the green color G discharge cell and the blue color B discharge cell may be greater than that of the red color R discharge cell.

A width of the green color G discharge cell may be substantially equal to or different from that of the blue color B discharge cell.

Accordingly, a width of a phosphor layer 214 to be described later formed within the discharge cell also changes according to that of the discharge cell. For example, a width of a blue color B phosphor layer formed in the blue color B discharge cell may be wider than that of a red color R phosphor layer formed within the red color R discharge cell, and a width of the green color G phosphor layer formed in a green color G discharge cell may be wider than that of a red color R phosphor layer formed within the red color R discharge cell.

Accordingly, color temperature characteristics of an embodied image can be improved.

Further, the plasma display panel that can be applied to the plasma display apparatus in the implementation can have structures of barrier ribs of various shapes as well as a structure of the barrier rib 212 shown in FIG. 2. For example, the barrier rib 212 comprises a first barrier rib 212*b* and a second barrier rib 212*a*, and may have a differential barrier rib structure in which a height of the first barrier rib 212*b* and a height of the second barrier rib 212*a* are different from each other, a channel type barrier rib structure in which a channel that can be used as an exhaust passage is formed in at least one of the first barrier rib 212*b* and the second barrier rib 212*a*, and a hollow type barrier rib structure in which a hollow is formed in at least one of the first barrier rib 212*b* and the second barrier rib 212*a*.

When the barrier rib 212 has the differential barrier rib structure, a height of the first barrier rib 212*b* may be lower than that of the second barrier rib 212*a*. When the barrier rib 212 has the channel type barrier rib structure, a channel may be formed in the first barrier rib 212*b*.

In the plasma display panel that can be applied to the plasma display apparatus in an implementation, the red color R, green color G, and blue color B discharge cells are arranged on the same line, however they may be arranged in other shapes. For example, the red color R, green color G, and blue color B discharge cells may be arranged in a delta type arrangement in which they are arranged in a triangular shape. Further, the discharge cells may have various polygonal shapes such as a pentagonal shape and a hexagonal shape as well as a quadrangular shape.

FIG. 2 shows only a case where the barrier rib 212 is formed in the rear substrate 211, however the barrier rib 212 may be formed in at least one of the front substrate 201 and the rear substrate 211.

A predetermined discharge gas is filled within a discharge cell partitioned by the barrier rib 212.

Further, a phosphor layer 214 for emitting visible light for displaying an image when an address discharge is generated is formed within the discharge cell partitioned by the barrier rib 212. For example, red color R, green color G, and blue color B phosphor layers may be formed.

Further, in addition to the red color R, green color G, and blue color B phosphor layers, white color W and/or yellow color Y phosphor layer may be further formed.

Further, a thickness of the phosphor layer 214 in at least one of the red color R, green color G, and blue color B discharge cells may be different from that in other discharge cells. For example, a thickness of a phosphor layer, i.e. a green color G phosphor layer in the green color G discharge cell, or a phosphor layer, i.e. a blue color B phosphor layer in the blue color B discharge cell may be thicker than that of a phosphor layer, i.e. the red color R phosphor layer in the red color R discharge cell. Here, a thickness of the green color G phosphor layer may be substantially equal to or different from that of the blue color B phosphor layer.

Only an example of the plasma display panel that can be applied to the plasma display apparatus in an implementation is described, however this document is not limited to the plasma display panel having the above-described structure. For example, only a case where each of an upper dielectric layer and a lower dielectric layer is formed in a single layer is described, however at least one of the upper dielectric layer and the lower dielectric layer may be formed in a plurality of layers.

In addition, in order to prevent reflection of external light due to a barrier rib, a black layer (not shown) for absorbing external light may be further formed in an upper part of the barrier rib 212.

Further, another black layer (not shown) may be further formed in a specific position on the front substrate 201 corresponding to the barrier rib 212.

Further, the third electrode 213 formed on the rear substrate 211 may have a substantially uniform width or thickness, however a width or a thickness within the discharge cell may be different from a width or a thickness outside the discharge cell. For example, a width or a thickness within the discharge cell or thickness may be wider or thicker than that outside the discharge cell.

Figure 3:
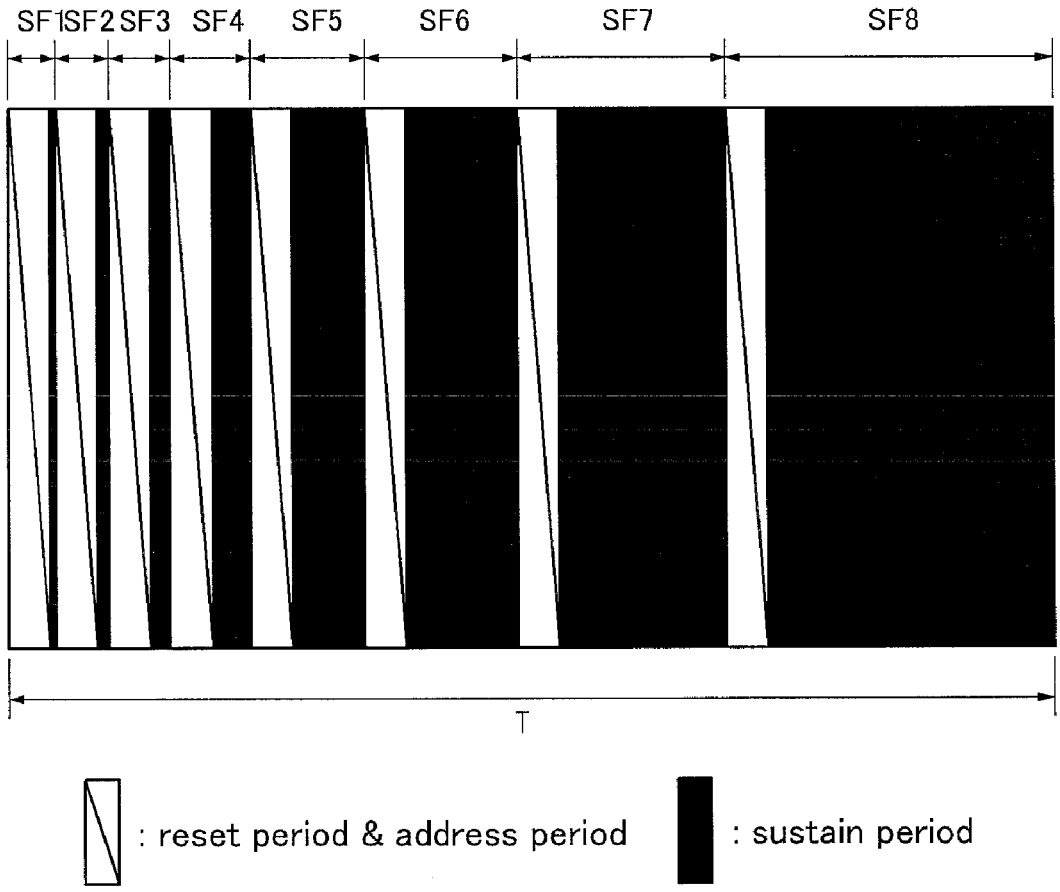
FIG. 3 is a diagram illustrating an image frame for embodying a gray level of an image in a plasma display apparatus in an implementation.

FIG. 3 is a diagram illustrating an image frame for embodying a gray level of an image in a plasma display apparatus in an implementation.

Referring to FIG. 3, an image frame for embodying a gray level of an image in the plasma display apparatus in an implementation can be divided into a plurality of subfields having different number of times of light emitting.

Further, although not shown, at least one subfield among the plurality of subfields can be divided into a reset period for initializing a discharge cell, an address period for selecting a discharge cell to be discharged, and a sustain period for embodying a gray level according to the number of times of a discharge.

For example, when it intends to display an image with 256 gray levels, for example, one image frame is divided into 8 subfields (SF1 to SF8), as in FIG. 3, each of 8 sub-fields (SF1 to SF8) is subdivided into a reset period, an address period, and a sustain period.

By adjusting the number of sustain signals supplied in a sustain period, a gray level weight of a corresponding subfield can be set. That is, by using a sustain period, a predetermined gray level weight can be given to each subfield. For example, by setting a gray level weight of the first subfield to $2^0$ and a gray level weight of the second subfield to $2^1$, a gray level weight of each subfield can be determined so that a gray level weight of each subfield increases in a ratio of $2^n$ (where n=0, 1, 2, 3, 4, 5, 6, 7). By adjusting the number of sustain signals supplied in a sustain period of each subfield according to a gray level weight in each subfield, a gray level of various images is embodied.

The plasma display apparatus in an implementation uses a plurality of image frames in order to embody an image, for example in order to display an image of 1 second. For example, in order to display an image of 1 second, 60 image frames are used. In this case, a length T of one image frame may be 1/60 second, i.e. 16.67 ms.

FIG. 3 shows only a case where one image frame comprises 8 subfields, however the number of subfields constituting one image frame can be variously changed. For example, one image frame may comprise 12 subfields from a first subfield to a twelfth subfield, or 10 subfields.

Further, in FIG. 3, in one image frame, subfields are arranged in an increasing order of a gray level weight, however subfields may be arranged in a decreasing order of a gray level weight in one image frame or regardless of a gray level weight.

Figure 4:
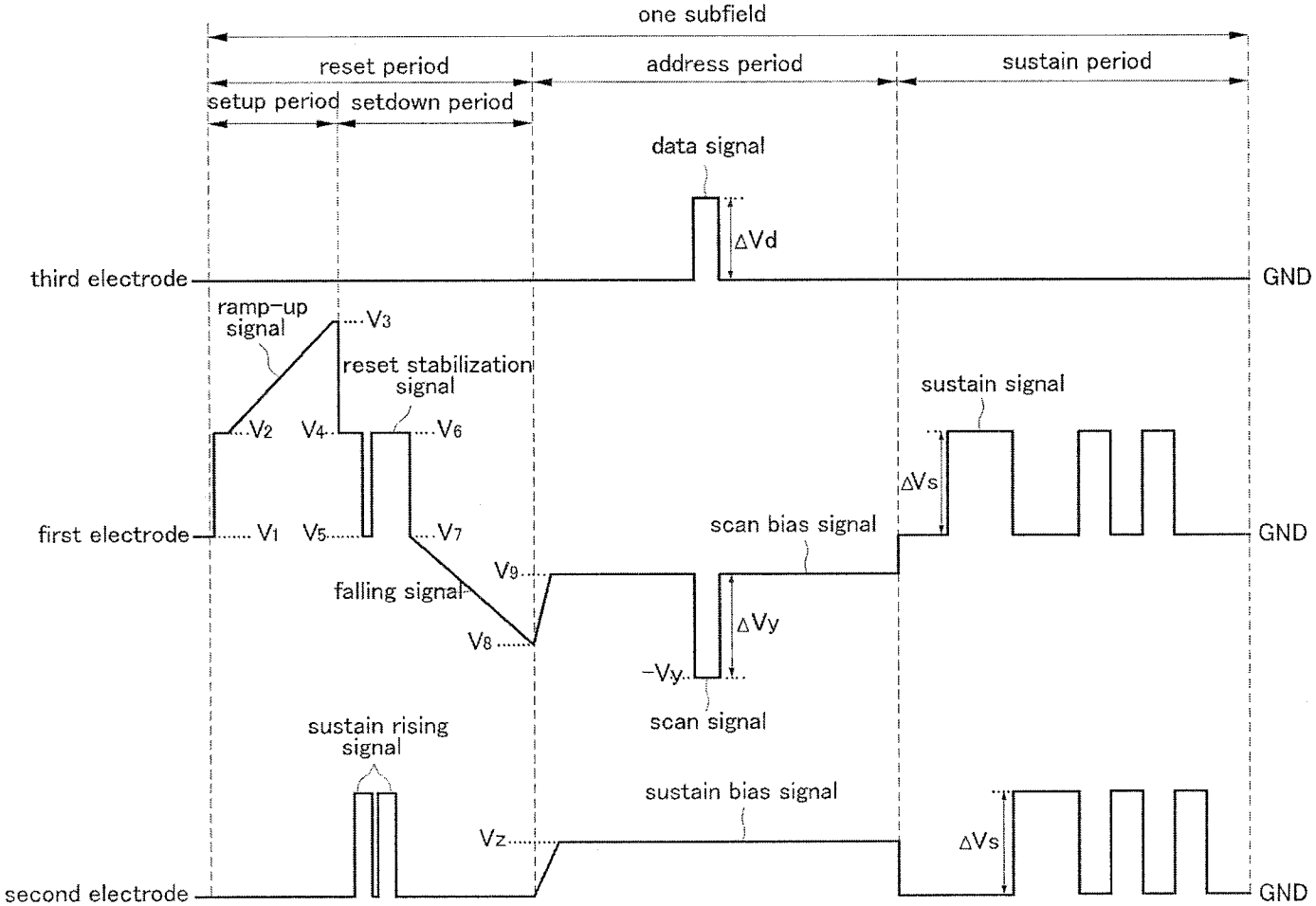
FIG. 4 is a diagram illustrating an example of an operation of the plasma display apparatus in an implementation in a subfield comprised in an image frame.

FIG. 4 is a diagram illustrating an example of an operation of the plasma display apparatus in an implementation in a subfield comprised in an image frame. Signals to be described hereinafter are supplied by the driver 110 of FIG. 1.

Referring to FIG. 4, in a setup period of a reset period for initialization, a ramp-up signal in which a voltage gradually rises from a second voltage V2 to a third voltage V3 after rapidly rising from a first voltage V1 to the second voltage V2 is supplied to the first electrode. The first voltage V1 may be a voltage of a ground level GND.

In the setup period, a weak dark discharge, i.e. a setup discharge is generated within a discharge cell by the ramp-up signal. By the setup discharge, some wall charges can be stacked within the discharge cell.

In a set down period after a setup period, a ramp-down signal having a polarity opposite to that of the ramp-up signal after the ramp-up signal is supplied to the first electrode.

The ramp-down signal gradually falls from a seventh voltage V7 lower than a peak voltage, i.e. the third voltage V3 of a ramp-up signal to an eighth voltage V8 after a reset stabilization signal rising from a fifth voltage V5 to a sixth voltage V6 is supplied.

As the ramp-down signal is supplied, a feeble erase discharge, i.e. a set down discharges is generated within the discharge cell. By the set down discharge, wall charges to stably generate an address discharge are uniformly remained within the discharge cell.

In a period before the ramp-down signal is supplied after the ramp-up signal is supplied to the first electrode, at least one reset stabilization signal is supplied to the first electrode and at least one sustain rising signal is supplied to the second electrode. The reset stabilization signal and the sustain rising signal are described in detail later.

A form of the ramp-up signal or the ramp-down signal can be variously changed. This is described with reference to FIG. 5.

Figure 5:
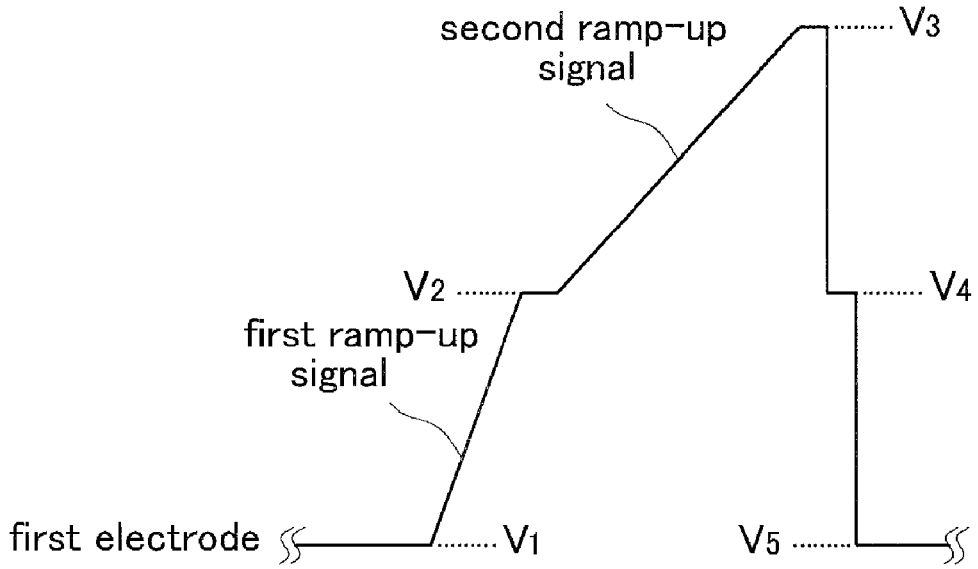
FIG. 5 is a diagram illustrating another example of the ramp-up signal and the ramp-down signal.
Figure 5:
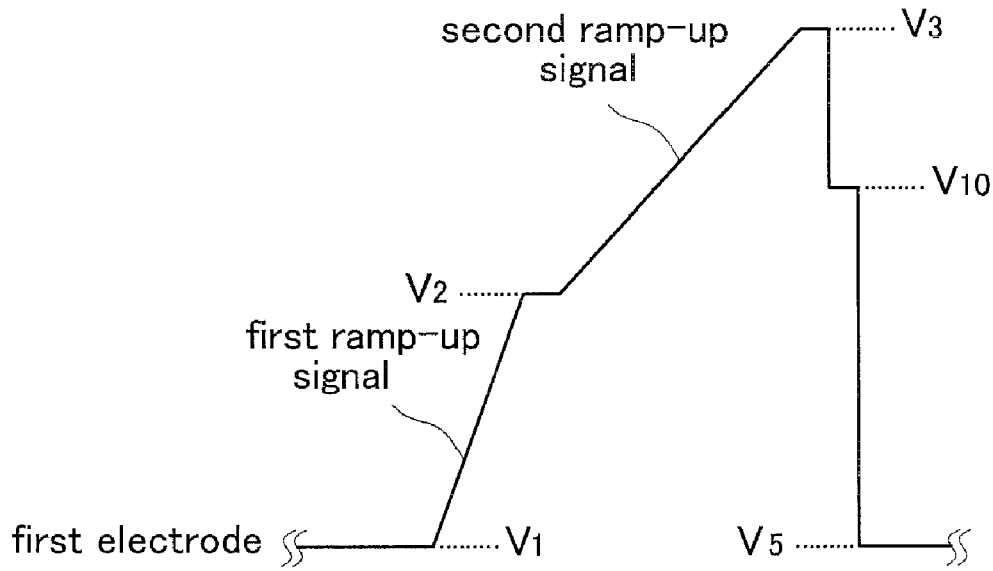

FIG. 5 is a diagram illustrating another example of the ramp-up signal and the ramp-down signal.

Referring to FIG. 5, a ramp-up signal may comprise a first ramp-up signal and a second ramp-up signal having different slopes, as in FIG. 5(*a*).

The first ramp-up signal gradually rises with a first slope from the first voltage V1 to the second voltage V2, and the second ramp-up signal gradually rises with a second slope from the second voltage V2 to the third voltage V3.

The second slope of the second ramp-up signal may be gentler than the first slope. If the second slope is gentler than the first slope, a voltage relatively rapidly rises until a setup discharge is generated, and a voltage relatively slowly rises while a setup discharge is generated, so that an amount of light generating by a setup discharge is reduced.

Accordingly, contrast characteristics can be improved.

Otherwise, as in FIG. 5(*b*), after the supply of a ramp-up signal is terminated, a voltage can fall again up to the fifth voltage V5 after falling up to a tenth voltage V10 different from the fourth voltage V4 of FIG. 5(*a*).

A pre-reset period may be further comprised before a reset period. This is described with reference to FIG. 6.

Figure 6:
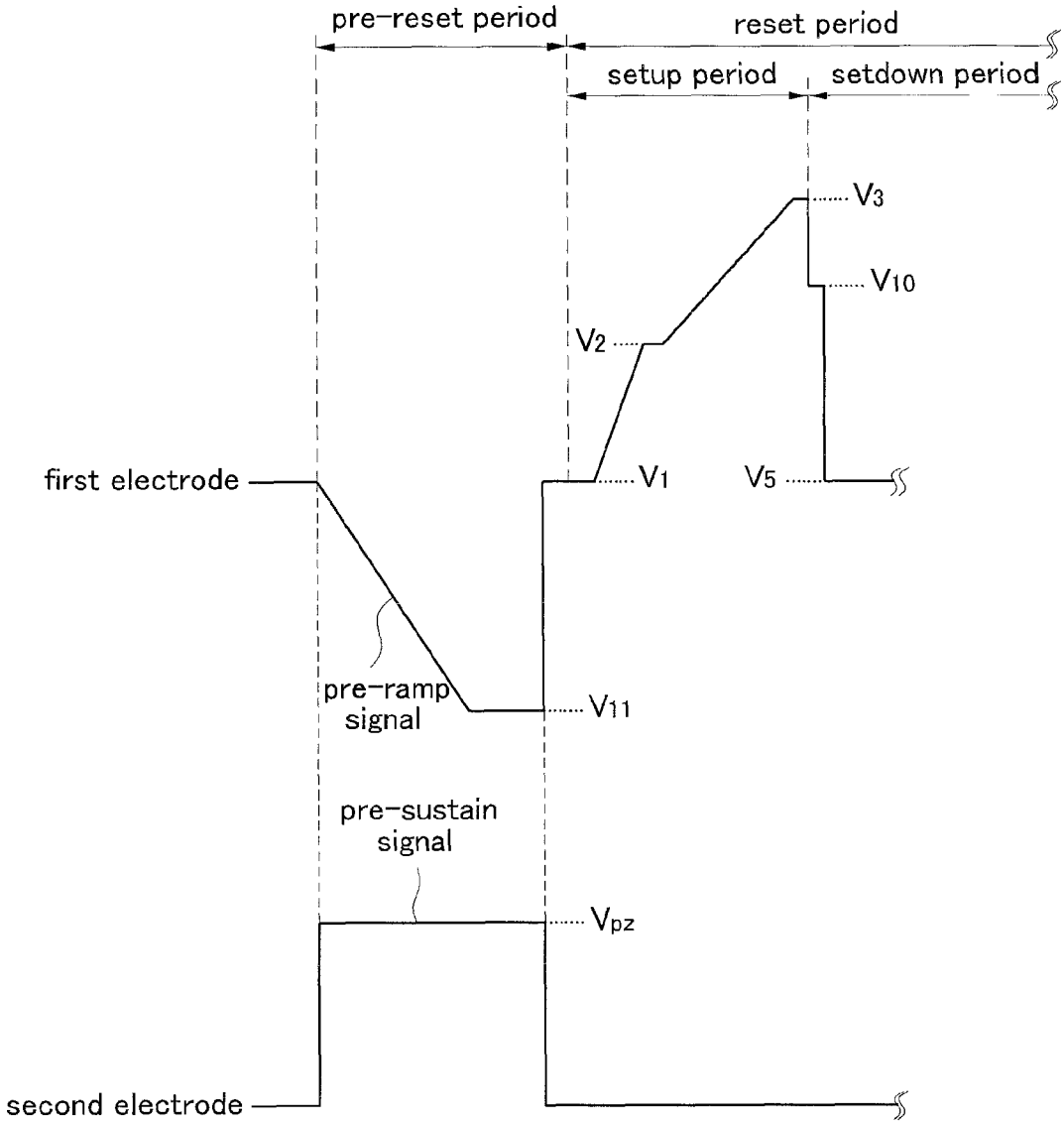
FIG. 6 is a diagram illustrating a pre-reset period.

FIG. 6 is a diagram illustrating a pre-reset period.

Referring to FIG. 6, a pre-reset period may be comprised before a reset period, and a pre-ramp signal gradually falling up to an eleventh voltage V11 can be supplied to the first electrode Y in the pre-reset period.

Further, while a pre-ramp signal is supplied to the first electrode, a pre-sustain signal of a polarity opposite to that of the pre-ramp signal can be supplied to the second electrode.

Further, a pre-sustain signal can substantially uniformly sustain a pre-sustain voltage Vpz. Here, the pre-sustain voltage Vpz may be equal to a voltage, i.e. a sustain voltage Vs of a sustain signal to be supplied in the sustain period.

A pre-ramp signal is supplied to the first electrode in a pre-reset period, and if a pre-sustain signal is supplied to the second electrode, a predetermined polarity of wall charges are stacked on the first electrode, and wall charges of a polarity opposite to that of the first electrode are stacked on the second electrode. For example, positive (+) wall charges are stacked on the first electrode, and negative (−) wall charges are stacked on the second electrode.

Accordingly, a setup discharge of enough intensity can be generated in a reset period after a pre-reset period, and initialization can be performed fully stably.

Further, even if a voltage of a ramp-up signal supplied to the first electrode in a reset period becomes small, a setup discharge of enough intensity can be generated.

In order to secure a driving time, a pre-reset period may be comprised before a reset period in a most preceding subfield in a time order among subfields of an image frame, or a pre-reset period may be comprised before a reset period in 2 or 3 subfields among subfields of the image frame.

Otherwise, the pre-reset period may be omitted in all subfields.

In an address period after a reset period, a scan bias signal for substantially sustaining a voltage higher than a lowest voltage, i.e. an eighth voltage V8 of a ramp-down signal is supplied to the first electrode.

Further, a scan signal falling by a scan voltage ΔVy from a scan bias signal can be supplied to the first electrode.

A width of a scan signal can be varied in a subfield unit. That is, in at least one subfield, a width of a scan signal may be different from that of a scan signal in other subfields. For example, a width of a scan signal in a subfield positioned in a rear side in a time order may be smaller than that of a scan signal in a subfield positioned in a front side in a time order.

When a scan signal is supplied to the first electrode, a data signal rising by a magnitude ΔVd of a data voltage can be supplied to the third electrode so as to correspond to a scan signal.

As the scan signal and the data signal are supplied, a wall voltage by wall charges generated in a reset period is added to a voltage difference between the scan signal and the data signal, whereby an address discharge can be generated within a discharge cell to which the data signal is supplied.

A sustain bias signal can be supplied to the second electrode in order to prevent that an address discharge becomes unstable due to interference of the second electrode in an address period.

The sustain bias signal can substantially uniformly sustain a sustain bias voltage Vz smaller than a voltage of a sustain signal supplied in a sustain period and greater than a voltage of a ground level GND.

Thereafter, in a sustain period for displaying an image, a sustain signal can be supplied to at least one of the first electrode and the second electrode. For example, a sustain signal can be alternatively supplied to the first electrode and the second electrode.

If the sustain signal is supplied, in a discharge cell selected by an address discharge, when the sustain signal is supplied while a sustain voltage Vs of the sustain signal is added to a wall voltage within the discharge cell, a sustain discharge, i.e. a display discharge can be generated between the first electrode and the second electrode.

An image can be embodied using this method.

The reset stabilization signal and the sustain rising signal are described in detail.

Figure 7:
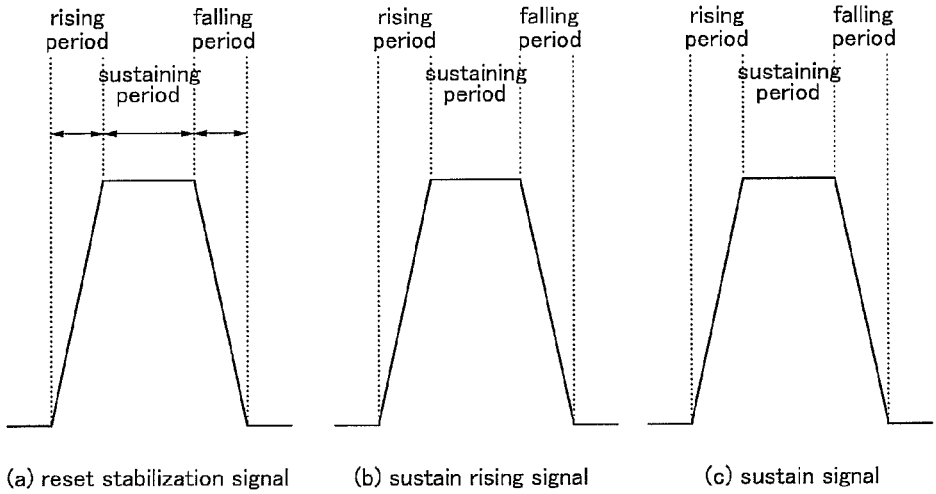
FIG. 7 is a diagram illustrating a reset stabilization signal, a sustain rising signal, and a sustain signal.

FIG. 7 is a diagram illustrating a reset stabilization signal, a sustain rising signal, and a sustain signal.

Referring to FIG. 7, the reset stabilization signal, the sustain rising signal, and the sustain signal comprise a rising period, a sustain period, and a falling signal.

FIG. 7(*a*) shows a reset stabilization signal, FIG. 7(*b*) shows a sustain rising signal, and FIG. 7(*c*) shows a sustain signal.

A rising period of the reset stabilization signal is a period in which a voltage rises from a lowest voltage to a highest voltage of the reset stabilization signal, and a sustain period of the reset stabilization signal is a period in which the highest voltage of the reset stabilization signal sustains the voltage during a predetermined time, and a falling period of the reset stabilization signal is a period in which a voltage falls from the highest voltage to the lowest voltage of the reset stabilization signal Further, a period to which all of the rising period, the sustain period, and the falling period of the reset stabilization signal are added is a width of the reset stabilization signal, and the width of the reset stabilization signal can be changed. This is described later.

Description of the sustain rising signal and a rising period, a sustain period, and a falling period of the sustain signal are substantially equal to that of the reset stabilization signal and therefore a detailed description thereof is omitted.

A rising period of the sustain rising signal is substantially equal to that of the sustain signal, and if a highest voltage of the sustain rising signal is substantially equal to that of the sustain signal, a slope of the sustain rising signal is substantially equal to that of the sustain signal, an energy recovery circuit can be shared, and the same voltage generator can be used.

Figure 8:
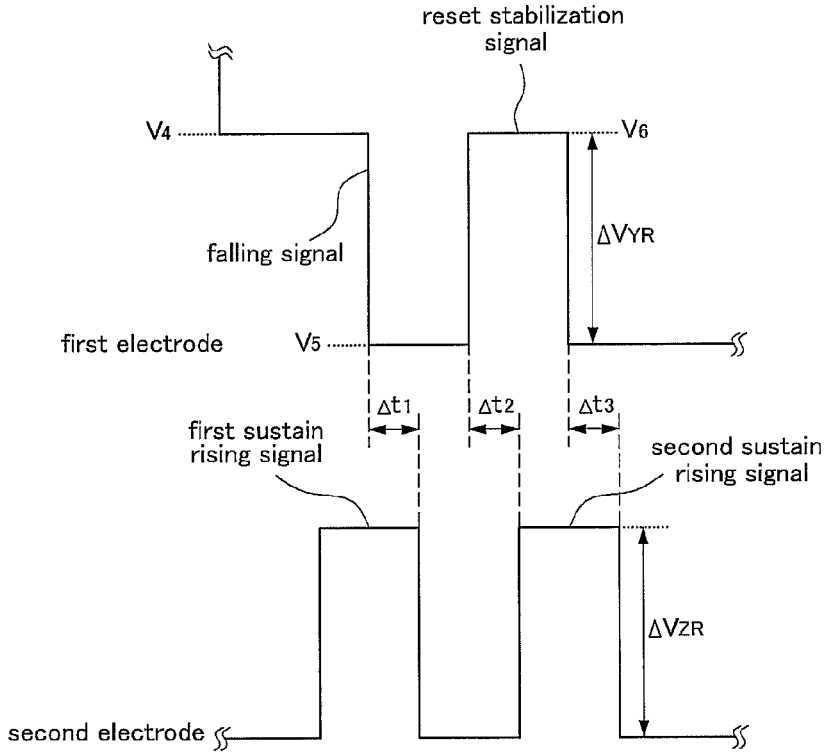
FIG. 8 is a diagram illustrating a reset stabilization signal and a sustain rising signal.

FIG. 8 is a diagram illustrating a reset stabilization signal and a sustain rising signal.

Referring to FIG. 8, in a period before a ramp-down signal is supplied after a ramp-up signal is supplied, at least one reset stabilization signal is supplied to the first electrode, and at least one sustain rising signal is supplied to the second electrode.

A voltage magnitude ΔVYR of the reset stabilization signal is substantially equal to a voltage magnitude ΔVZR of the sustain rising signal. Further, a voltage magnitude ΔVYR of at least one reset stabilization signal or a voltage magnitude ΔVZR of at least one sustain rising signal can be substantially equal to a voltage magnitude ΔVs of a sustain signal supplied to at least one of the first electrode and the second electrode in a sustain period.

A reason of supplying the reset stabilization signal and the sustain rising signal is described as follows.

It is assumed that due to excessively larger intensity of a setup discharge generating in a setup period of a reset period, an amount of wall charges excessively increases within a discharge cell.

In this case, due to an excessively larger amount of wall charges, even if an address discharge is not generated in an address period, an erroneous discharge such as a sustain discharge may be generated in a sustain period. Accordingly, a picture quality of an image is deteriorated.

As in an implementation, if a reset stabilization signal is supplied to the first electrode and a sustain rising signal is supplied to the second electrode, a discharge may be generated between the first electrode and the second electrode by a reset stabilization signal and a sustain rising signal before an address discharge is generated in an address period.

A portion of wall charges excessively stacked by a discharge generating by the reset stabilization signal and the sustain rising signal is erased, whereby in a discharge cell in which an address discharge is not generated, a sustain discharge is not generated. Accordingly, by suppressing generation of an erroneous discharge, deterioration of a picture quality of an image can be prevented.

Further, if a width of the reset stabilization signal or a width of the sustain rising signal is substantially greater than that of a sustain signal, a discharge such as a sustain discharge is generated, thereby increasing an amount of light, so that contrast characteristics can be reduced. Accordingly, a width of the reset stabilization signal or a width of the sustain rising signal becomes substantially smaller than that of the sustain signal, and thus even if a discharge is generated, an amount of light becomes smallest and thus reduction of contrast characteristics is prevented.

Further, at least one reset stabilization signal and at least one sustain rising signal are overlapped.

For example, as in FIG. 8, when the sustain rising signal comprises a first sustain rising signal and a second sustain rising signal, the second sustain rising signal and the reset stabilization signal may be overlapped.

When a difference Δt2 between supply time points of the overlapped reset stabilization signal and sustain rising signal, i.e. the reset stabilization signal and the second sustain rising signal is excessively small, intensity of a discharge becomes excessively small and thus wall charges cannot be fully erased. Further, when a difference Δt2 between supply time points of the overlapped reset stabilization signal and sustain rising signal is excessively large, after a predetermined portion of wall charges is erased by a discharge, wall charges are again stacked and thus an amount of wall charges excessively increases in a discharge cell.

In other words, a sustain period of the reset stabilization signal and a rising period of the sustain rising signal or a falling period of the sustain rising signal may be overlapped, and a rising period of the reset stabilization signal and a rising period of the sustain rising signal may not be overlapped.

Due to such a reason, a difference Δt2 between supply time points of the overlapped reset stabilization signal and sustain rising signal, i.e. the reset stabilization signal and the second sustain rising signal can be set to 100 ns to 600 ns or 200 ns to 400 ns.

Further, due to a reason substantially identical to a reason why a difference Δt2 between supply time points of the overlapped reset stabilization signal and sustain rising signal, i.e. the reset stabilization signal and the second sustain rising signal is set to 100 ns to 600 ns or 200 ns to 400 ns, a difference Δt3 between termination time points of the overlapped reset stabilization signal and sustain rising signal, i.e. the reset stabilization signal and the second sustain rising signal may be 100 ns to 600 ns or 20 ns to 400 ns.

While a most preceding sustain rising signal (i.e., a first sustain rising signal) in a time order among a plurality of sustain rising signals is supplied, a falling signal with a gradually falling voltage, for example a fourth voltage V4 lower than a peak voltage of a ramp-up signal to a fifth voltage V5 can be supplied to the first electrode after the supply of a ramp-up signal.

When a falling signal is supplied, a discharge generates between the first electrode and the second electrode, whereby a predetermined portion of wall charges excessively stacked within a discharge cell can be erased. Accordingly, generation of an erroneous discharge can be prevented.

When a difference Δt1 between a termination time point of a falling signal and that of a most preceding sustain rising signal in a time order i.e. the first sustain rising signal among a plurality of sustain rising signals is excessively small, intensity of a discharge is excessively small, whereby wall charges cannot be fully erased. Further, when a difference Δt1 between a termination time point of a falling signal and that of the first sustain rising signal is excessively large, after a predetermined portion of wall charges are erased by a discharge generated by the falling signal and the first sustain rising signal, wall charges can be stacked again.

Due to such a reason, the difference Δt1 between a termination time point of the falling signal and that of a most preceding sustain rising signal in a time order, i.e. the first sustain rising signal among the plurality of sustain rising signals can be set to 100 ns to 600 ns or 200 ns to 400 ns.

A case where the number of sustain rising signals is plural has been described. Alternatively, the number of sustain rising signals may be 1.

Figure 9:
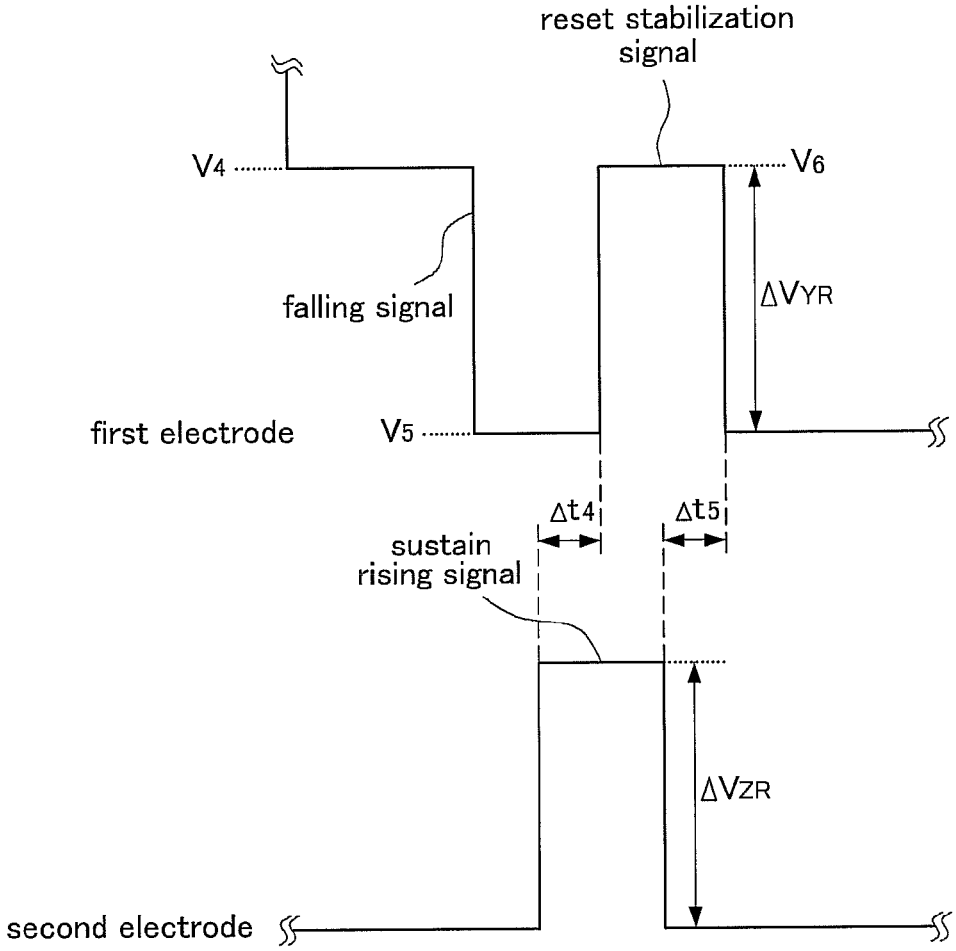
FIG. 9 is a diagram illustrating an example of changes in the number of sustain rising signals.

FIG. 9 is a diagram illustrating an example of a change of the number of sustain rising signals.

Referring to FIG. 9, the number of sustain rising signals may be 1. The sustain rising signal may be overlapped with the reset stabilization signal.

A difference Δt4 between a supply time point of the sustain rising signal and a supply time point of the reset stabilization signal can be set to 100 ns to 600 ns or 200 ns to 400 ns due to the above-described reason.

Further, a difference Δt5 between a supply time point of the sustain rising signal and a supply time point of the reset stabilization signal can be set to 100 ns to 600 ns or 200 ns to 400 ns due to the above-described reason.

A voltage magnitude of the sustain rising signal or the reset stabilization signal and a supply time of a rising signal can be changed. This is described as follows.

Figure 10:
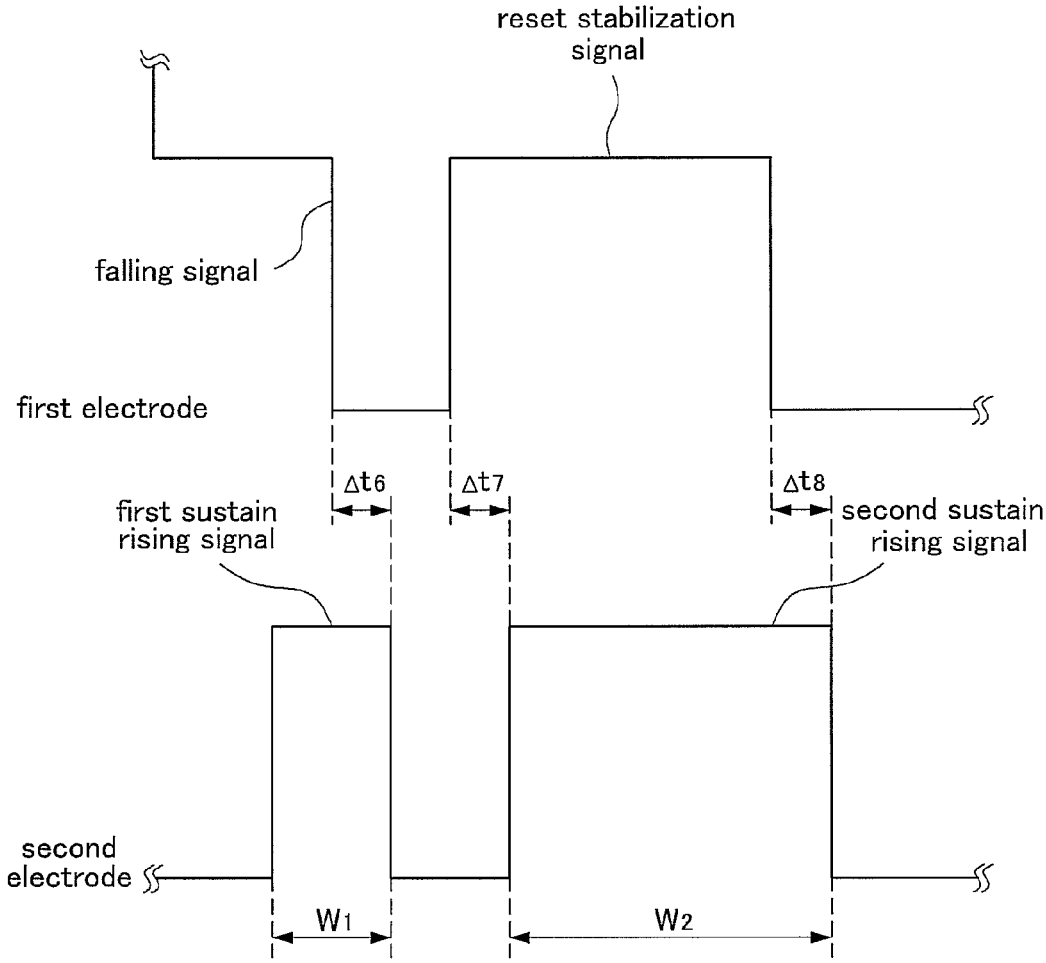
FIGS. 10 to 12 are diagrams illustrating a voltage magnitude of a reset stabilization signal or a sustain rising signal and a supply time of a rising signal.
Figure 11:
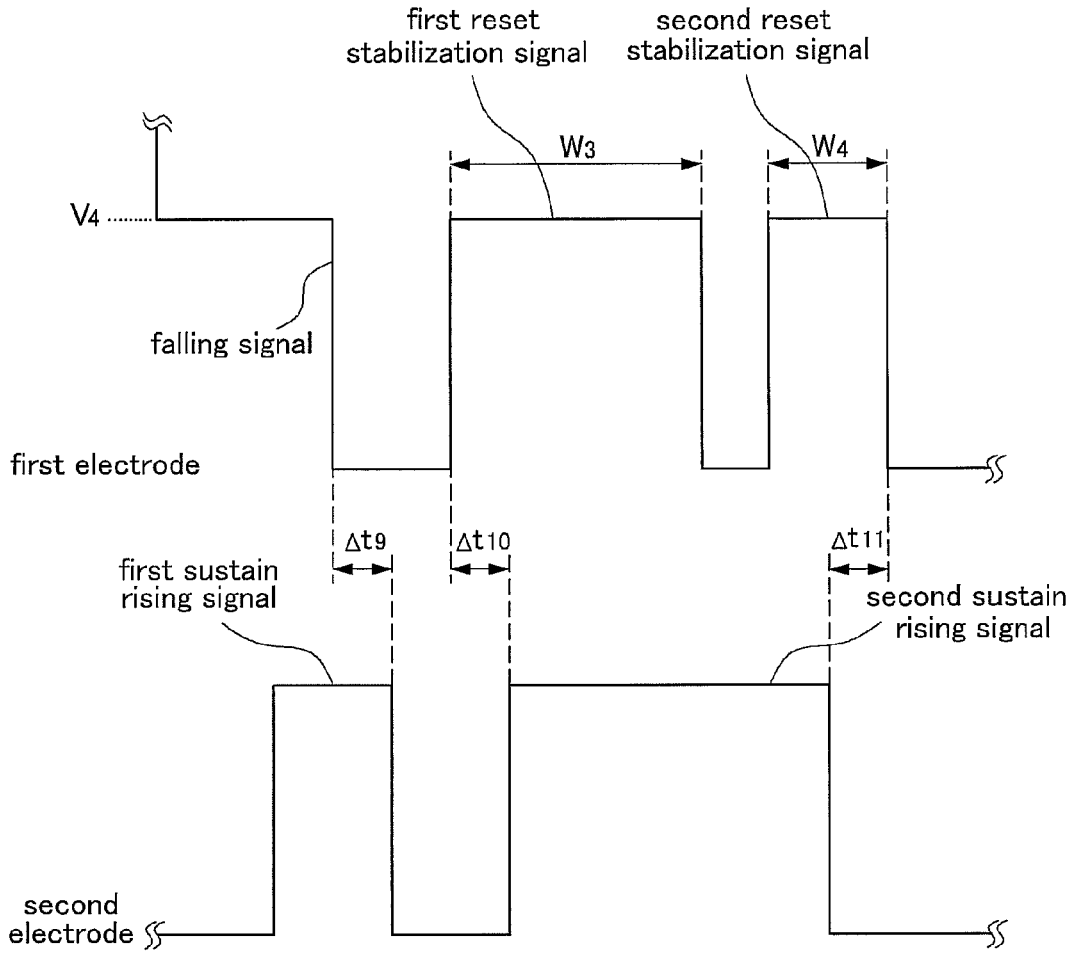
Figure 12:
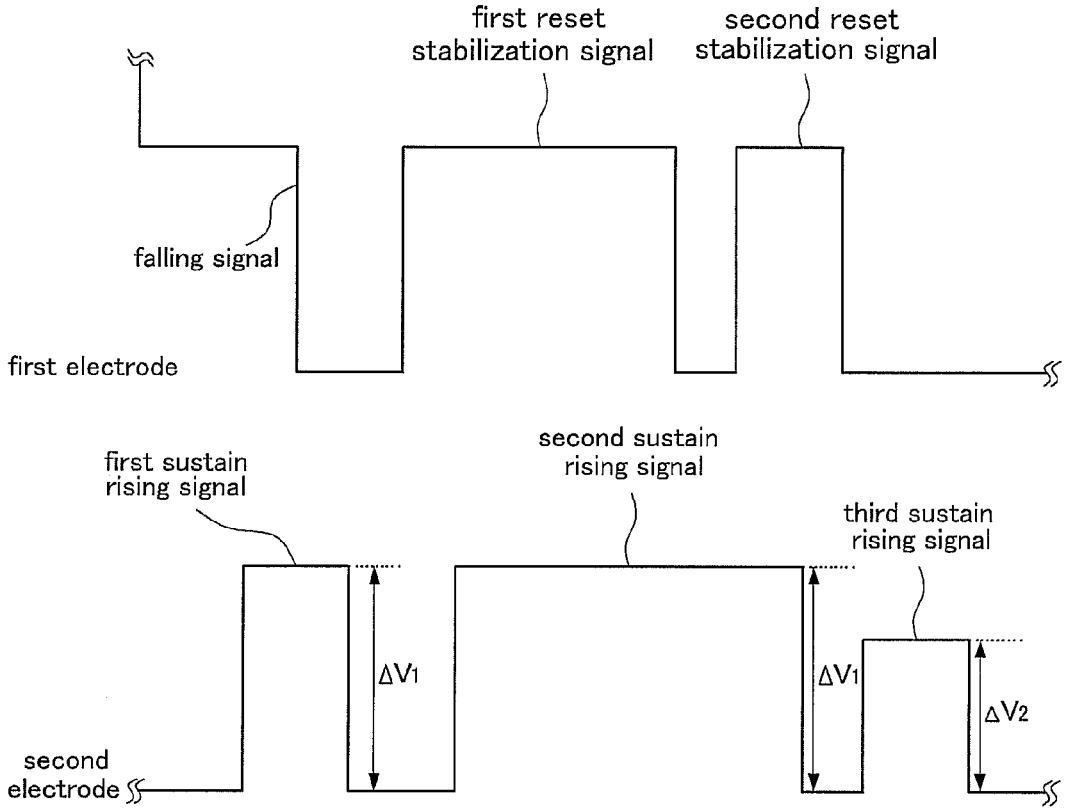

FIGS. 10 to 12 are diagrams illustrating a voltage magnitude of a reset stabilization signal or a sustain rising signal and a supply time of a rising signal.

Referring to FIG. 10, the number of sustain rising signals is plural, and a supply time of at least one of a plurality of sustain rising signals is different from that of other sustain rising signals.

For example, the sustain rising signal comprises a first sustain rising signal and a second sustain rising signal, and a supply time W1 of the first sustain rising signal may be longer than a supply time W2 of the second sustain rising signal.

In FIG. 10, a difference Δt6 between a termination time point of a falling signal and a termination time point of the first sustain rising signal, a difference Δt7 between an supply time point of the reset stabilization signal and a supply time point of the second sustain rising signal, or a difference Δt8 between a termination time point of the reset stabilization signal and a termination time point of the second sustain rising signal can be set to 100 ns to 600 ns or 200 ns to 400 ns due to the above-described reason.

Referring to FIG. 11, the number of the reset stabilization signals is plural, a supply time of at least one of the plurality of reset stabilization signals is different from that of other reset stabilization signals.

For examples the reset stabilization signal comprises a first reset stabilization signal and a second reset stabilization signal, and a supply time W3 of the first reset stabilization signal may be longer than a supply time W4 of the second reset stabilization signal.

In FIG. 11, the second sustain rising signal is commonly overlapped to the first reset stabilization signal and the second reset stabilization signal.

Further, a difference Δt9 between a termination time point of a falling signal and a termination time point of the first sustain rising signal, a difference Δt10 between a supply time point of the first reset stabilization signal and a supply time point of the second sustain rising signal, or a difference Δt11 between a termination time point of the second reset stabilization signal and a termination time point of the second sustain rising signal can be set to 100 ns to 600 ns or 200 ns to 40 ns due to the above-described reason.

Referring to FIG. 12, the number of sustain rising signals is plural, a voltage magnitude of at least one of the plurality of sustain rising signals is different from that of other sustain rising signals.

For example, the sustain rising signal comprises a first sustain rising signal, a second sustain rising signal, and a third sustain rising signal, and a voltage magnitude ΔV1 of the first sustain rising signal and the second sustain rising signal may be greater than a voltage magnitude ΔV2 of the third sustain rising signal.

As described above, a pulse width or a voltage magnitude of the reset stabilization signal or the sustain rising signal can be variously changed.

If a temperature of the plasma display panel changes, distribution characteristics of wall charges within a discharge cell can be also changed. For example, at a specific temperature, an amount of wall charges within the discharge cell may be excessively increased. Accordingly, an erroneous discharge may be generated.

As in an implementation, if the reset stabilization signal and the sustain rising signal are supplied to the first electrode and the second electrode, the plasma display panel can prevent generation of an erroneous discharge at a specific temperature. That is, generation of an erroneous discharge related to a temperature of the plasma display panel can be prevented.

Figure 13:
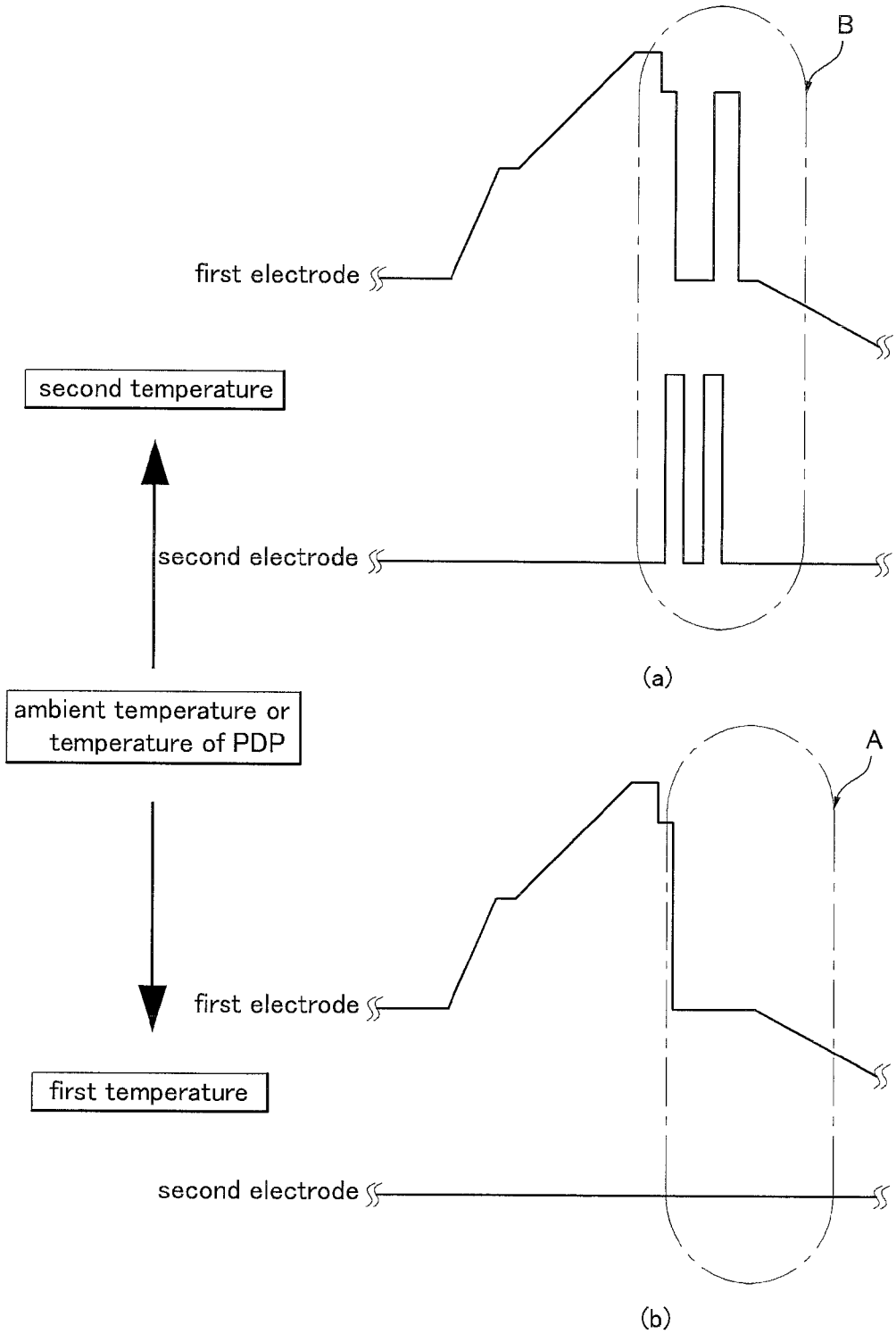
FIG. 13 is a diagram illustrating an example of a method of using a reset stabilization signal and a sustain rising signal in consideration of an ambient temperature or a temperature of a plasma display panel.

FIG. 13 is a diagram illustrating an example of a method of using a reset stabilization signal and a sustain rising signal in consideration of an ambient temperature or a temperature of a plasma display panel.

Referring to FIG. 13, when an ambient temperature or a temperature of the plasma display panel is a first temperature, the reset stabilization signal and the sustain rising signal are omitted, as in A area, and when an ambient temperature or a temperature of the plasma display panel is a second temperature higher than the first temperature, the reset stabilization signal and the sustain rising signal can be supplied to the first electrode and the second electrode, as in B area. Such a setting reason is described as follows.

As a temperature of the plasma display panel increases, a discharge firing voltage gradually decreases due to a reason such as deterioration of a dielectric layer. Accordingly, in a second temperature in which a temperature of the plasma display panel is relatively high, an amount of wall charges excessively increases after a reset period, compared to the first temperature. Therefore, in a first time period having a relatively stable amount of wall charges, the reset stabilization signal and the sustain rising signal are not used, and in a second time period having excessively much amount of wall charges, the reset stabilization signal and the sustain rising signal are used.

At this time, the first temperature period is a normal temperature period of 0 to 40° C., and the second temperature period is a high temperature period exceeding 40° C.

Figure 14:
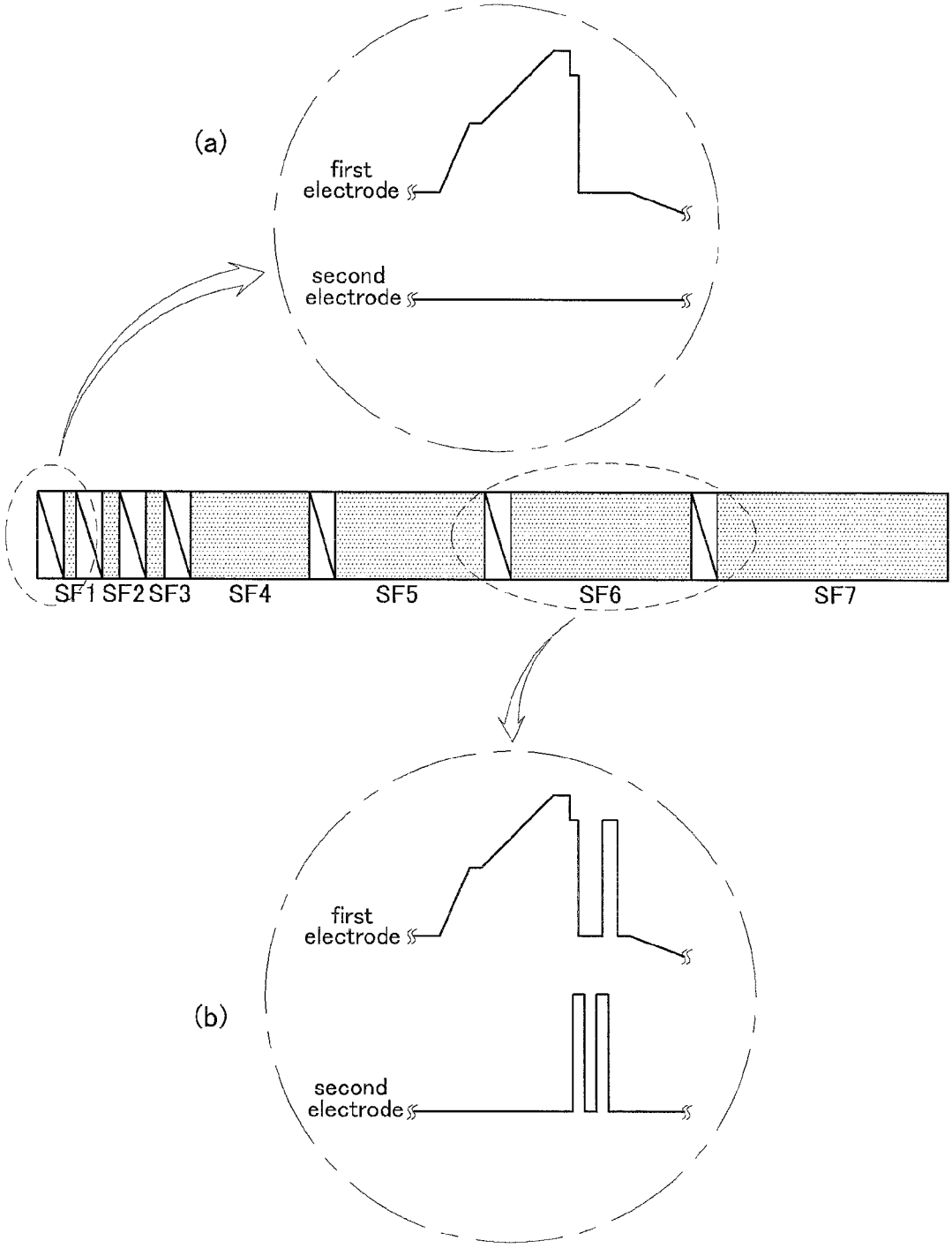
FIG. 14 is a diagram illustrating an example of a method of using a reset stabilization signal and a sustain rising signal in a random subfield within an image frame.

FIG. 14 is a diagram illustrating an example of a method of using a reset stabilization signal and a sustain rising signal in a random subfield within an image frame.

As in FIG. 14, it is assumed that one image frame comprises total 7 subfields (SF1, SF2, SF3, SF4, SF5, SF6, and SF7).

The rising signal and the sustain rising signal may not be supplied in a low gray level subfield. The low gray level subfield may be a third subfield or less. As in FIG. 14(*a*), in the first subfield SF1, the reset stabilization signal and the sustain rising signal may not be supplied. However, as in FIG. 14(*b*), in a sixth subfield SF6 having a gray level weight different from that of the first subfield SF1, the reset stabilization signal and the sustain rising signal can be used.

In this way, if the reset stabilization signal and the sustain rising signal are used in a random subfield of a plurality of subfields of an image frame, a driving margin can be fully secured.

As described above, in a plasma display apparatus in an implementation, by erasing a predetermined portion of wall charges excessively stacked in a setup period using a reset stabilization signal and a sustain rising signal between a ramp-up signal and a ramp-down signal, generation of an erroneous discharge is prevented and thus deterioration of a picture quality of an image is prevented.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel comprising a first electrode and a second electrode; and a driver that supplies a ramp-up signal in which a voltage gradually rises to the first electrode in a setup period of a reset period, supplies a ramp-down signal in which a voltage gradually falls to the first electrode in a set down period following the setup period, supplies at least one reset stabilization signal to the first electrode in a period before the ramp-down signal is supplied after the ramp-up signal is supplied, and supplies at least one sustain rising signal to the second electrode in a period before the ramp-down signal is supplied after the ramp-up signal is supplied, wherein the reset stabilization signal includes a first reset stabilization signal and a second reset stabilization signal, wherein the sustain rising signal includes a first sustain rising signal, a second sustain rising signal, and a third sustain rising signal.

2. The plasma display apparatus of claim 1, wherein a highest voltage of the reset stabilization signal is substantially identical to a highest voltage of the sustain rising signal or a highest voltage of a sustain signal supplied to the first electrode or the second electrode during a sustain period.

3. The plasma display apparatus of claim 1, wherein a width of the first reset stabilization signals is different from a width of the second reset stabilization signals.

4. The plasma display apparatus of claim 1, wherein a width of the first sustain rising signals is different from a width of the second sustain rising signals.

5. The plasma display apparatus of claim 4, wherein a width of at least one of the reset stabilization signal or the sustain rising signal is smaller than a width of the sustain signal.

6. The plasma display apparatus of claim 1, wherein a voltage magnitude of the third sustain rising signals is different from a voltage magnitude of the first and second sustain rising signals.

7. The plasma display apparatus of claim 1, wherein the at second reset stabilization signal and the first and second sustain rising signal are overlapped in at least one part.

8. The plasma display apparatus of claim 7, wherein a difference between supply time points of the first reset stabilization signal and the second sustain rising signal is 100 ns to 600 ns, and a difference between termination time points of the second reset stabilization signal and the second sustain rising signal is 100 ns to 600 ns.

9. The plasma display apparatus of claim 1, wherein during a time period in which a most preceding sustain rising signal in a time order among a plurality of sustain rising signals is supplied to the second electrode, after the ramp-up signal is supplied to the first electrode, a falling signal is supplied in a voltage lower than a peak voltage of the ramp-up signal.

10. The plasma display apparatus of claim 1, wherein when an ambient temperature or a temperature of the plasma display panel is a second temperature higher than a first temperature, the reset stabilization signal is supplied to the first electrode.

11. The plasma display apparatus of claim 10, wherein the first temperature is 0 to 40° C., and the second temperature exceeds 40° C.

12. The plasma display apparatus of claim 1, wherein a period rising up to a highest voltage of a sustain signal is substantially identical to a period rising up to a highest voltage of the sustain rising signal.

13. A method of driving a plasma display apparatus comprising a first electrode and a second electrode, comprising:

supplying a ramp-up signal in which a voltage gradually rises to the first electrode in a setup period of a reset period, and supplying a ramp-down signal in which a voltage gradually falls to the first electrode in a set down period after the setup period, supplying at least one reset stabilization signal to the first electrode in a period before the ramp-down signal is supplied after the ramp-up signal is supplied, and supplying at least one sustain rising signal to the second electrode in a period before the ramp-down signal is supplied after the ramp-up signal is supplied, wherein the reset stabilization signal includes a first reset stabilization signal and a second reset stabilization signal, wherein the sustain rising signal includes a first sustain rising signal, a second sustain rising signal, and a third sustain rising signal.

14. The method of claim 13, wherein a highest voltage of the reset stabilization signal is substantially identical to a highest voltage of the sustain rising signal or a highest voltage of a sustain signal supplied to the first electrode or the second electrode during a sustain period.

15. The method of claim 13, wherein a width of at least one of the reset stabilization signal or the sustain rising signal is smaller than a width of the sustain signal.

16. The method of claim 13, wherein a voltage magnitude of the third sustain rising signals is different from a voltage magnitude of the first and second sustain rising signals.

17. The method of claim 13, wherein the second reset stabilization signal and the first and second sustain rising signal are overlapped in at least one part.

18. The method of claim 13, wherein when an ambient temperature or a temperature of the plasma display panel is a second temperature higher than a first temperature, the reset stabilization signal is supplied to the first electrode.

* * * * *